United States Patent [19]

Coyle

[11] 4,072,511

[45] Feb. 7, 1978

[54] METHOD OF PRODUCING SILICON CONTAINING CAST IRON

[75] Inventor: John D. Coyle, Cedarville, Mich.

[73] Assignees: Harold Huston, Tonawonda, N.Y.; Ronald Beyerstedt, Wapaca, Wis.

[21] Appl. No.: 744,985

[22] Filed: Nov. 26, 1976

[51] Int. Cl.[2] ..... C22C 33/08

[52] U.S. Cl. ..... 75/130 R; 75/130 A

[58] Field of Search ..... 75/130 A, 130 R, 51, 75/10 R, 59

[56] References Cited

U.S. PATENT DOCUMENTS

| | | | |
|---|---|---|---|
| 2,569,146 | 9/1951 | Bolkcom | 75/130 A |
| 3,051,564 | 8/1962 | Drenning | 75/130 R |
| 3,574,596 | 4/1971 | Lohman | 75/51 |
| 3,575,695 | 4/1971 | Miyashita | 75/51 |
| 3,728,107 | 4/1973 | Loricchio | 75/130 R |

*Primary Examiner*—P. D. Rosenberg

*Attorney, Agent, or Firm*—McGlynn and Milton

[57] ABSTRACT

A method of producing cast iron including the steps of providing an initial cupola charge having a silicon content less than the silicon content required, melting the charge, conducting the melt to a mixing vessel, substantially increasing the silicon content of the melt by adding granular silicon carbide to the mixing vessel while simultaneously agitating the melt to achieve a good mix and conducting the silicon-enriched melt to a holding vessel or a molding line.

12 Claims, 2 Drawing Figures

METHOD OF PRODUCING SILICON CONTAINING CAST IRON

FIELD OF THE INVENTION

This invention relates to a method of producing cast iron and is specifically directed to a method wherein significant adjustments are made to the silicon content of the melt during transfer from a cupola to a holding vessel in a duplexing system.

BACKGROUND OF THE INVENTION

As is well-known, silicon is an essential alloying element in the production of cast iron, particularly the group of cast irons known as gray irons. Silicon not only promotes graphitization of carbon, but also increases the hardness and strength of the ferrite phase. Common commercially used gray irons include approximately 2.25 weight percent silicon. Depending upon the required properties, however, the silicon content may vary from 2.00 to 3.00 weight percent.

Heretofore, almost all of the silicon has been supplied by the initial cupola charge. In other words, the silicon contained in the metallics and in auxiliary additives in the cupola charge provide the silicon necessary to meet the specifications of the melt. In determining the composition of the initial charge, consideration must be given to the fact that silicon is lost through oxidation during melting. Silicon loss is particularly acute with a basic or neutral slag. Basic or neutral slags are desirable, however, because they favor a high carbon curve.

The amount of silicon lost ranges between 10% and as much as 40% depending on the cupola and the particular operating conditions. Hence, excess silicon must be provided in the initial charge to insure that the desired amount of silicon will be present in the melt. Even though excess silicon is provided in the initial charge, care must nevertheless be taken during melting to avoid a loss of silicon in excess of the predicted loss. Obviously, if the silicon loss during melting exceeds the predicted loss, the silicon content of the melt will fall below the desired level even though excess silicon was proved in the initial charge.

Due to the fact that the initial charge must have a relatively high silicon content (on the order of 2.6 – 2.75% to produce 2.25% at the cupula spout) it has long been felt that a large portion of the ferrous-base material, or metallics, in the charge must have relatively high silicon contents. Hence, ferrous-base materials, such as pig iron, foundry returns and purchased cast iron scrap, are used in greater quantities than steel scrap because the former have significantly higher silicon contents than the latter. This adds, however, to the material cost of the initial charge since steel scrap is less expensive than the average cost (or value) of pig iron, foundry returns, and purchased cast iron scrap. In addition, silicon must also be added to the charge in the form of auxiliary additives to give the desired amount. Silicon additions are generally made in the following forms: (1) silicon carbide, briquettes which contain approximately 38 – 75% silicon carbide, the compound silicon carbide containing 70% silicon and 30% carbon, (2) ferrosilicon which contains approximately 50%, 75% or 85% silicon depending on the type used, (3) silvery pig which contains 8 – 20% silicon and (4) silicon briquettes. One or more of these auxiliary silicon additives are used to increase the silicon content of the cupola charge and add to the cost of the charge.

For a number of reasons, it would be advantageous to ignore, or at least reduce the efforts which must be made in controlling the silicon content of the initial cupola charge and during subsequent melting. Less expensive metallics, such as steel scrap, cast iron borings and steel turnings, can be used in the initial cupola charge due to the high carbon pickup and move uniform carbon curve which can be achieved with a lower silicon input. It should also be apparent that a lower silicon input facilitates a more uniform silicon curve. Another economic advantage is that the use of auxiliary silicon additives can be eliminated from the initial cupola charge. This increases the carbon recovery or pickup from the coke that is used as a fuel and for carbon pickup. Therefore, the amount of coke and air needed to melt the charge can be reduced without a loss in temperature. Reducing the amount of coke in the charge also produces an increase in the melt rate. Another advantage is that the cupola operator has greater flexibility in the type of slag run with the melt since there is less need to protect the silicon content with the slag. For example, it is normally undesirable to run a basic slag if a high silicon content is required due to the high loss of silicon caused by a basic slag. On the other hand, a basic slag is desirable if it is necessary to reduce the sulfur and phosphorous contents of the iron. If it is unnecessary to control the silicon content the cupola operator need not balance these two competing interests.

Past practice has been dictated partly by tradition and partly due to the fact that it is difficult to add significant amounts of silicon to the melt. This is due, in part, to the low specific gravity of liquid silicon (or the silicon and its carrier) with respect to the molten iron,. Hence, the liquid silicon tends to float on the surface of the molten iron. As a result, the silicon does not become mixed with the melt. Additionally, the floating silicon tends to freeze on surfaces of the holding and transfer equipment thus plugging the system.

Final adjusting of the silicon content of the melt has been attempted by additions to the transfer or pouring ladle. Heretofore, such procedures have been effective in producing only minor changes in the silicon content of the melt, measured on the order of tenths of a percent. Silicon has also been added as an inoculant to the transfer or pouring ladle, but this also produces very little change in the overall silicon content of the melt. In all heretofore known procedures, the major source of silicon has been the metallics and auxiliary additives used in the initial charge. In other words, post-melting additions of silicon have been relied upon to effect only minor changes in the silicon content of the melt. In all cases, the silicon content of the initial cupola charge has been at least equal to, and normally greater than, the desired silicon content of the melt. Thus, the accepted practice is to use a high percentage of the more expensive silicon rich metallics in the initial charge, to add auxiliary silicon bearing additives and to make special provisions to protect the silicon content during melting.

BRIEF SUMMARY OF THE INVENTION

This invention provides a method of producing cast iron by which a significant increase in the silicon content can be achieved in the iron after melting. Hence, as suggested by the preceding, large savings can be made in material and fuel costs. Moreover, aspects of the melting procedure can be simplified because the concern over maintaining the high silicon content during melting is reduced or eliminated.

Briefly, the method includes providing a duplexed system consisting of a cupola and a holding vessel. A mixing vessel is located intermediate the cupola and the holding vessel. The melt is conducted from the cupola to the mixing vessel where the silicon content of the melt is increased by an addition of a silicon-containing additive, such as granular silicon carbide, to the mixing vessel while simultaneously agitating the melt. The silicon-enriched melt is then conducted to the holding vessel. Since a significant increase (0.50 - 2.50 percent by weight) in the silicon content of the melt can be achieved in this manner, the method also includes providing an initial cupola charge having a total silicon content less than the silicon content required at the pouring stage.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
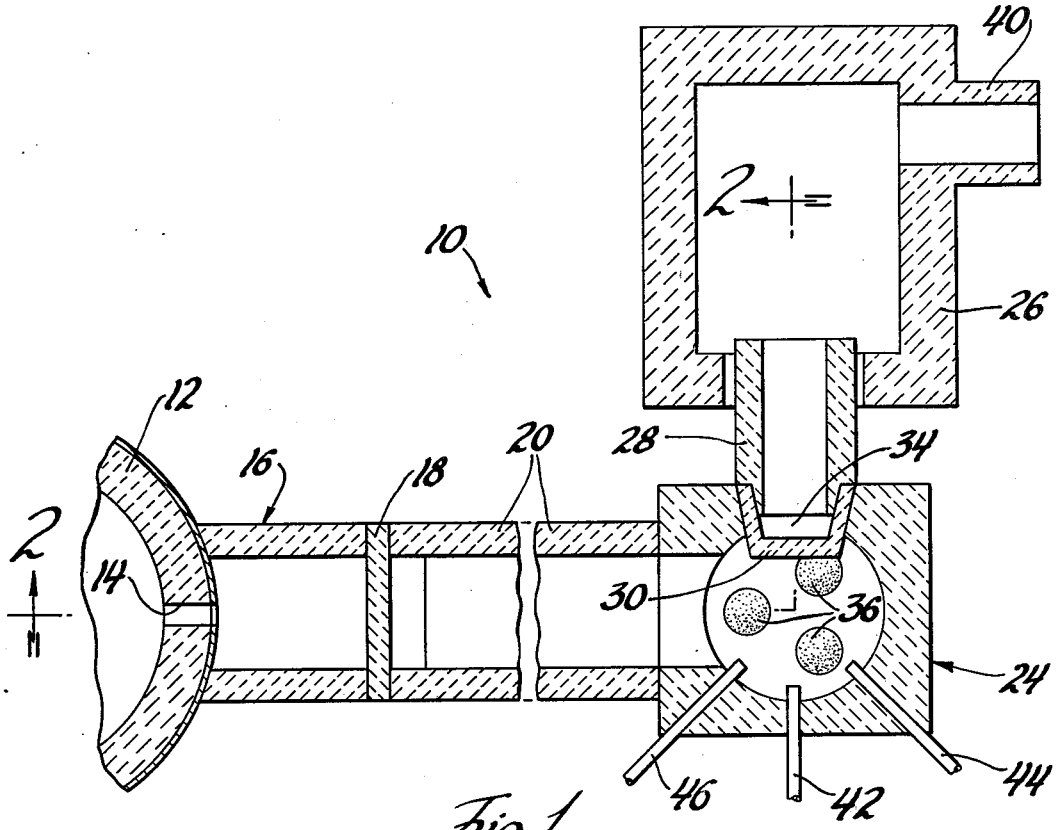
FIG. 1 if a plan view of a duplexed system for producing cast iron constructed in accordance with the instant invention and FIG. 2 is a cross-sectional view taken generally along line 2—2 of FIG. 1.
Figure 2:
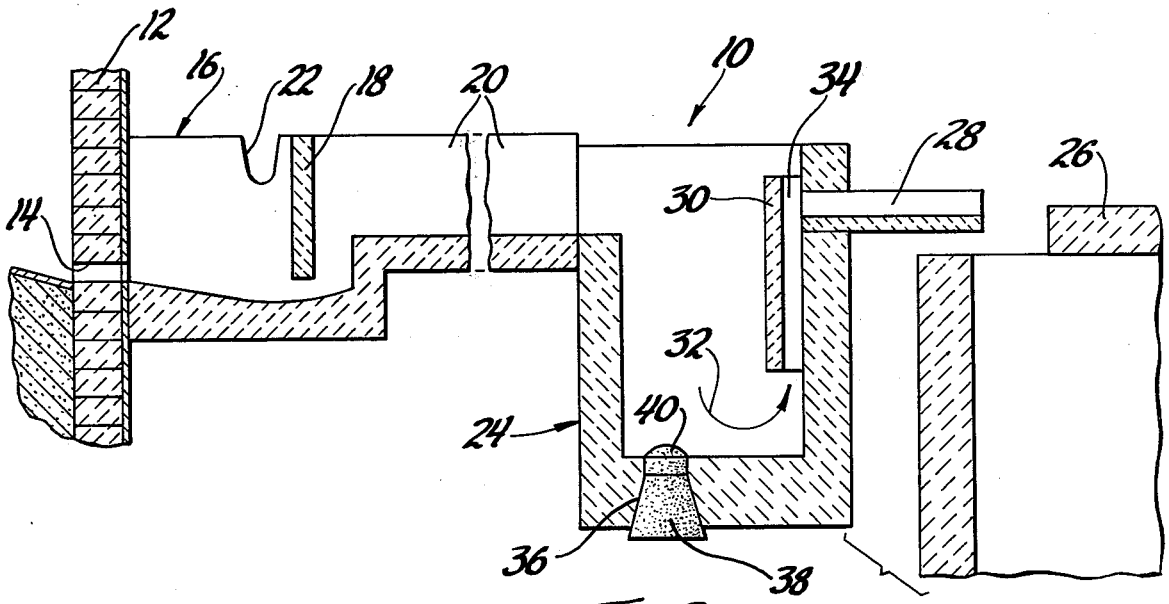

Referring more particularly to the drawings, a duplexed melting system for producing cast iron in accordance with the instant invention is generally shown at 10. The duplexed melting system 10 includes a cupola 12 having a tap hole 14 which feeds a continuous-tapping from slagging spout, generally indicated at 16. The continuous-tapping front slagging spout 16 is of conventional design and includes a slag dam 18 which forms a well of molten metal topped by a slag layer. The molten metal flows under the slag dam 18 and down a spout extension 20. The slag runs off through a slag notch 22 in the wall of the spout 16.

While a specific continuous tapping system is shown for purposes of illustration, it is to be recognized that the invention disclosed herein is applicable to intermittent tapping systems as well.

The spout extension 20 conducts the molten metal to a mixing vessel, generally indicated at 24. As will be more thoroughly described herein, the mixing vessel 24 is employed to increase the silicon content of the melt by an addition of a silicon-containing additive, preferably granular silicon carbide. The molten metal is then conducted into a holding vessel, such as an electric furnace 26, where it is held before being transferred, as needed, to ladles for transport to the pouring floor.

As should be apparent, the mixing vessel 24 serves an important function in achieving the desired results. Generally, the mixing vessel 24 is constructed of standard refractory materials and includes a teapot-type spout 28. The deflector 30 of the teapot-type spout 28 forces the metal to flow from the bottom of the mixing vessel 24 through the passage 34 in the direction indicated by the arrow 32. This type of spout aids thorough mixing by promoting turbulence and reducing dead spots in the mixing vessel 24. It is essential, however, that the metal be agitated sufficiently to insure substantially homogeneous mixing of the silicon in the metal. Adequate agitation in the mixing vessel 24 is provided by forcing an inert gas, such as nitrogen, through multiple porous plugs 36 located in the bottom of the mixing vessel 24. Each of the porous plugs include a gas-permeable, ceramic body 38 which is located in an opening in the bottom lining of the mixing vessel 24. In order to prevent metal penetration of the ceramic body 38, a depression is provided above the body 38 which is filled with bonded sodium silicate sand 40. A porous plug of this type is described in U.S. Pat. No. 2,871,008, granted Jan. 27, 1959. A suitable nipple (not shown) is connected to the porous plug 36 which in turn is connected to a gas supply line for conducting gas to the porous plug. Inert gas forced through the porous plug 38 will enter the metal in the form of finely divided bubbles which agitate the metal as they rise to the surface.

Mixing vessels of the type described have been used for various purposes in the production of cast iron, e.g., desulfurizing and recarbonizing iron on a continuous basis. Such mixing vessels, however, only have a single porous plug located in the center of the bottom lining. It has been observed that a single porous plug produces a mushroom-like flow pattern which causes most of the agitation to occur in the central portion of the mixing vessel. In order to increase the agitation of the metal, multiple porous plugs are employed.

In experiments run using a mixing vessel having a capacity of approximately three to four tons, three symetrically arranged porous plugs 36 were employed. Nitrogen was supplied to each of the porous plugs 36 at a rate of approximately 10 cubic feet per minute. This resulted in a good rolling action throughout the melt. It is noted that an increase in the capacity of the mixing vessel 24 may require additional porous plugs to produce sufficient agitation in the melt.

The silicon and carbon content of the metal is increased by adding granular silicon carbide. Silicon carbide is used because it contains both silicon and carbon while other additives contain only one or the other. By increasing the silicon and carbon content of the metal at the mixing vessel in the manner described, much closer control of the chemistry of the metal can be maintained. It is standard foundry practice to monitor the carbon equivalent of the metal at the spout 40 of the holding vessel 26. According to customary practice, fluctuations in the carbon equivalent have been corrected by adjusting the alloy content of the charge going into the cupola. Emergency corrections to the chemistry of the metal are also made at the spout of the holding vessel by additions of hardening or softening inoculants. This procedure presents a twofold problem. First of all, there is a time lag of at least an hour from the top of the cupola to the spout. Hence, there is a significant delay between the time corrections to the chemistry of the charge going into the cupola are made and the time at which such corrections actually begin to take effect. In other words, the extra silicon and carbon added to the cupola are at least an hour away from the holding vessel. The second problem is related to the first in that, during the interim, ladle additions must be made to the melt to produce castings which meet specification. Ladle additions are, of course, expensive and increase the material cost of the metal. Moreover, there is a limit as to the amount of material which can be added. As a general rule, only 2 - 6 pounds of inoculant per ton of metal can be added to the holding vessel. Standard inoculants contain a maximum of about 60% silicon.

Hence, only about a 0.15% increase in the silicon content can be achieved in this manner.

By increasing the silicon and carbon content of the metal in the mixing vessel, almost immediate adjustment of the carbon equivalent can be achieved. This is so regardless of the natural fluctuations in the carbon equivalent which occur during the melting process. Additionally, more accurate adjustments can be made. The tendency to overcompensate is reduced because the effects of the silicon addition can be measured almost immediately. Thus a great amount of guesswork can be eliminated.

The granular silicon carbide is introduced into the mixing vessel 24 through a pipe 42. The pipe 42 is fed from a suitable storage container (not shown) by means of an electrically operated vibratory feeder. Such vibratory feeders are well-known in the industry and, hence, do not require further description. It is noted, however, that such vibratory feeders include rheostat controls for adjusting the rate of flow of the material being fed into the pipe 42. Hence, the rate at which silicon carbide is being added to the metal can be adjusted to correct fluctuations in the carbon equivalent being measured at the spout of the holding vessel 26. Generally, the silicon content is added to the melt on a continuous basis at a rate which may fluctuate depending on the silicon content and/or carbon equivalent of the melt. As suggested above, only slight fluctuations in the silicon and carbon content should occur since a more consistent carbon and silicon curve will result from the lower silicon input.

While the mixing vessel 24 is primarily used to increase the silicon content of the melt by the addition of silicon carbide, it is also convenient to make appropriate adjustments to the carbon content at this stage. Hence, a second pipe 44 may be provided for introducing a carbonaceous material into the melt. Carbonaceous material (e.g. graphite) is only added when there is a need to increase the carbon content of the melt above that which can be achieved by the silicon carbide being introduced. In other words, it is contemplated that the carbonaceous material would not be fed into the melt on a continuous basis, as is generally the case with the silicon carbide, since the carbon content should normally be close to the desired amount at the cupola spout. This is due, in part, to the closer control of the carbon content and the increased carbon pickup which can be achieved by removing the limitations imposed on the melting process by the need to maintain the silicon content. An electrically operated vibratory feeder may also be used for supplying a controlled amount of carbonaceous material to the feed pipe 44.

Additionally, in the event that the carbon content of the metal at the cupola spout becomes too high, a third feed pipe 46 is provided for introducing a suitable material for increasing only the silicon content. For example, ferro-silicon can be introduced into the melt through the third feed pipe 46. The ferrosilicon will maintain the carbon content of the melt while simultaneously increasing the silicon content. However, ferrosilicon is only added on a periodic basis when needed since continuous additions of ferrosilicon will eventually solidify the slag layer in the holding vessel. It is to be remembered, however, that the significant advantages described herein are achieved because the silicon content of the melt can be increased by the continuous addition of silicon carbide to the melt.

One of the most significant advantages of the method disclosed herein is the large savings which can be made in the cost of materials and fuel. Due to the fact that the metallics and auxiliary additives need not be the primary source of silicon in the metal, greater flexibility can be achieved in making up the initial cupola charge. As mentioned above, it has been standard practice to include in the initial charge a large portion of metallics having relatively high silicon contents. Therefore, pig iron, foundry returns, and purchased cast iron scrap made up most of the charge. Since, by employing the method described herein, it is no longer necessary for the metallics to provide a source of silicon, metallics having lower silicon contents may be used. In other words, greater amounts of steel scrap and cast iron borings may be used to make up the cupola charge. These metallics are significantly less expensive than those metallics containing higher silicon contents. The use of auxiliary silicon containing additives can also be eliminated. Additionally, the reduction of the silicon content of the cupola charge increases the carbon recovery from the coke that is used. Hence, the amount of coke can be reduced to maintain the desired temperature. A reduction in the amount of coke also increases the melt rate of the cupola since less material is being charged. It has been observed that at least a 15% higher melt rate can be achieved over the melt rate of a standard charge.

By way of example, Table 1 indicates the charge makeup of a standard charge in accordance with current foundry practices and two modified charges which have been composed in accordance with the instant invention. It is pointed out that the modified charges have been successfully melted on a production scale.

TABLE I

| | POSSIBLE MODIFICATIONS IN STANDARD CUPOLA CHARGE | | |
|---|---|---|---|
| Material | Standard Charge w/o | Modified Charge #1 w/o | Modified Charge #2 w/o |
| Steel | 30.0 | 60 | 67 |
| Cast Iron [a] | 68.25 | 39.5 | 0 |
| Borings [b] | 0 | 0 | 32.5 |
| SiC Briquette | 1.5 | 0 | 0 |
| Ferrosilicon (50%) | 0.5 | 0.5 | 0.5 |
| Coke [c] | 15.7 | 12.9 | 14.0 |
| SiC (grain) [d] | 0 | 1.6 | 1.95 |

[a] Includes pig iron, foundry returns, purchased cast iron scrap.
[b] Cast iron chips in cold-formed briquettes.
[c] Approximately 6:1 iron to coke ratio.
[d] Added to metal at mixing vessel.

The cost advantages of the modified charges shown in Table 1 will be immediately apparent by calculating the current cost per ton of steel scrap and borings as compared to pig iron, foundry returns, and purchased cast iron scrap. At current prices, savings on the order of 5 to 10 dollars per ton of molten metal can be easily achieved. It is also pointed out that the melt rate is 30% higher for the modified charge #1 as compared to the standard charge and 20% higher with modified charge #2. Thus cupola efficiency can be increased to further add to the economic advantages.

While some auxiliary silicon appears in the two modified charges in the form of ferrosilicon, it has been found that no silicon-containing additives are required. A charge made up of 70 w/o steel scrap and 30 w/o cast iron borings was melted without the benefit of any auxiliary silicon-containing additives. The predicted and observed silicon content at the spout was 0.9 percent by weight. The silicon content was successfully raised in the mixing vessel by the process described to 3.45 weight percent, an increase of over 2.5 percent silicon by weight. The resulting silicon content far exceeds the normal silicon requirement of gray iron and thus demonstrates the ability of the process to successfully raise the silicon content of the melt from relatively low to standard commercial levels.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A method of producing cast iron in a cupola comprising the steps of:

(a) providing an initial cupola charge having a silicon content significantly less than the silicon content required in the melt, (b) loading and melting the charge in a cupola, (c) conducting the molten metal to a mixing vessel, (d) increasing the silicon content by a substantially continuous addition of commercially pure granular silicon carbide to the mixing vessel while simultaneously agitating the molten metal by external means to an extent sufficient to bring the silicon into solution with the molten metal and (e) conducting the silicon-enriched molten metal away from the mixing vessel.

2. A method as set forth in claim 1 wherein the addition of granular silicon carbide increases the silicon content of the melt by an amount between about 0.50 – 2.50 percent by weight.

3. A method as set forth in claim 2 wherein the weight percent of steel and other low silicon ferrous-base materials in the initial charge exceeds the total weight percent of pig iron, foundry returns, and other relatively high silicon ferrous-base materials.

4. A method as set forth in claim 1 wherein the step of agitating the melt is further defined as introducing gas under pressure through multiple porous plugs located in the bottom of the mixing vessel.

5. A method as set forth in claim 4 including the step of increasing the carbon content of the melt by an addition of suitable carbonaceous material to the mixing vessel.

6. A method of producing cast iron in a cupola comprising the steps of:

(a) charging a cupola with a charge having a total silicon content significantly less than the silicon content required in the molten metal, (b) melting the charge, (c) conducting the melt to a mixing vessel, (d) increasing the silicon content of the melt by at least about 0.50 percent by weight by a substantially continuous addition of commercially pure granular silicon carbide to the mixing vessel while simultaneously agitating the melt by introducing gas under pressure through the bottom of the mixing vessel to mix the silicon with the melt, and (e) conducting the silicon-enriched melt to a holding vessel.

7. A method as set forth in claim 6 wherein the step of agitating the melt is further defined as introducing gas under pressure through multiple porous plugs located in the bottom of the mixing vessel to produce an extensive rolling action of the melt within the mixing vessel.

8. A method of producing grey iron in a cupola which permits the use of low silicon metallics in the cupola charge and the elimination of silicon-containing additives from the cupola charge comprising the steps of:

(a) providing an initial cupola charge including a substantial portion of silicon-poor metallics such that the total silicon content of the charge is significantly less than the silicon content required in the molten metal whereby the material cost of the initial cupola charge is reduced, (b) loading and melting the charge in a cupola, (c) conducting the molten metal to a mixing vessel, (d) increasing the silicon content of the molten metal by an addition of commercially pure granular silicon carbide in divided form to the mixing vessel while simultaneously agitating the melt by external means to an extent sufficient to bring the silicon into solution with the molten metal and (e) conducting the silicon-enriched melt away from the mixing vessel.

9. A method of producing grey iron in a cupola which permits the use of low silicon metallics in the cupola charge and the elimination of silicon containing additives from the cupola charge comprising the steps of:

(a) providing an initial cupola charge including a substantial portion of silicon poor metallics such that the total silicon content of the charge is significantly less than the silicon content required in the molten metal, (b) loading and melting the charge in a cupola, (c) conducting the molten metal to a mixing vessel, (d) increasing the silicon content of the molten metal by a substantially continuous addition of a silicon containing material to the mixing vessel while simultaneously agitating the melt by external means to an extent sufficient to bring the silicon into solution with the molten metal and (e) conducting the silicon enriched melt away from the mixing vessel.

10. A method as set forth in claim 9 wherein the steps of increasing the silicon content of the molten metal is further defined as increasing the silicon content of the molten metal by at least about 0.50 percent by weight.

11. A method as set forth in claim 10 wherein the silicon containing material added to the molten metal comprises commercially pure granular silicon carbide.

12. A method as set forth in claim 9 wherein agitating the melt by external means is further defined as introducing gas under pressure into the mixing vessel to cause agitation of the molten metal.

* * * * *